US006326738B1

(12) United States Patent
McAndrew

(10) Patent No.: US 6,326,738 B1
(45) Date of Patent: Dec. 4, 2001

(54) TWO WIRE LIGHT FOR ELECTRONIC DISPLAYS

(75) Inventor: Charlie McAndrew, Cypress, TX (US)

(73) Assignee: Innova Electronics, Inc., Houston, TX (US)

( * ) Notice: Subject to any disclaimer, the term of this patent is extended or adjusted under 35 U.S.C. 154(b) by 0 days.

(21) Appl. No.: 09/642,314

(22) Filed: Aug. 21, 2000

(51) Int. Cl.[7] ..... H05B 37/00
(52) U.S. Cl. ..... 315/227 R; 315/228; 315/229
(58) Field of Search ..... 315/98, 96, 97, 315/95, DIG. 7, 227 R, 228, 229

(56) References Cited

U.S. PATENT DOCUMENTS 6,118,227 * 9/2000 Beland ..... 315/276

* cited by examiner

*Primary Examiner*—David Vu
(74) *Attorney, Agent, or Firm*—Alan J. Atkinson

(57) ABSTRACT

An apparatus for illuminating an electronic display such as an LCD. A single hot wire is connected to multiple capacitors each dedicated to a cold cathode fluorescent tube, and multiple tubes are incorporated to illuminate the electronic display. Multiple hot wires are eliminated to eliminate excessive electrical losses and to reduce manufacturing cost.

14 Claims, 2 Drawing Sheets

TWO WIRE LIGHT FOR ELECTRONIC DISPLAYS

BACKGROUND OF THE INVENTION

The present invention relates to the field of illumination for electronic displays. More particularly, the invention relates to an improved apparatus for providing high brightness backlights for electronic displays such as liquid crystal displays (LCDs).

Cold cathode fluorescent lamps (CCFLs) provide backlight illumination for electronic displays such as LCDs. Multiple CCFL tubes are installed behind an LCD to increase the brightness and corresponding visibility of the illuminated display. CCFLs differ from conventional fluorescent light tubes. Conventional tubes warm up gases within the tube to "strike" or illuminate at a lower voltage than otherwise possible at ambient temperature. CCFLs do not use heater elements, and the internal gas ionization process for CCFLs is initiated by high voltage. To accomplish this high voltage, a separate capacitor is associated with each CCFL tube in series. A high voltage power supply such as an inverter provides up to 2000V AC to each capacitor at a frequency between 25 and 60 KHz.

Before each tube strikes to provide illumination there is infinite impedance across the tubes so that no current flows. Accordingly there is no voltage drop across the capacitors and the voltage across the tubes is the full inverter output voltage. When each tube strikes current flows therethrough and illuminates the region proximate to the tube. The value of the capacitor is that when the appropriate current flows the voltage drop reduces the tube voltage to the proper running value. For 300 mm long tubes, the operating voltage approximates 700V.

In multiple tube displays, a separate hot wire runs from the inverter to each capacitor and a common return wire completes the multiple circuits. For a six tube display, six hot wires and one return wire are required to provide the requisite voltage to each capacitor. Multiple wires increase manufacturing difficulty and expense and limits the ability to shrink the overall system size. Each wire increases electrical loss due to high frequency radiation. In addition, each additional wire reduces the operating reliability of the system by increasing the number of components subject to failure.

For larger displays and for uses requiring bright displays, the quantity and density of tubes increases the number of wires leading from the inverter to the tubes. If the density of tubes could be increased for a display, a slimmer backlight would be possible and less diffuser material would be required to blend the produced light. The average current consumed by each tube in a dense configuration could be less to achieve the same overall illumination, thereby extending the useful tube life for each individual tube. However merely adding more tubes would result in the disadvantages associated with multiple lead wires.

A need, therefore, exists for an improved CCFL system capable of providing high brightness illumination for electronic displays. The system should be efficient to manufacture, should increase the density of tubes associated with an electronic display, and should be reliable.

SUMMARY OF THE INVENTION

The invention provides an apparatus connectable to a power supply for illuminating an electronic display. The invention comprises a base, at least two cold cathode fluorescent tubes attached to the base for illuminating the electronic display, a capacitor engaged with and dedicated to each of the tubes, a slot in the base between the capacitor ends for isolating at least part of the capacitor from the base, a common wire engaged with each tube and with the power supply, and a hot wire engaged with the power supply and with each capacitor for completing an electrical circuit between the power supply and each tube.

In another embodiment of the invention, the apparatus comprises a first circuit board and a second circuit board, and a plurality of cold cathode fluorescent tubes for illuminating the electronic display. Each tube has one end attached to a hot electrical lead on the first circuit board and has another end attached to a common electrical lead on the second circuit board. A plurality of capacitors are engaged with the first circuit board, a first wire is connected between the power supply and the hot electrical lead, and a second wire is connected between the common electrical lead and the power supply.

DESCRIPTION OF THE PREFERRED EMBODIMENTS

Figure 1:
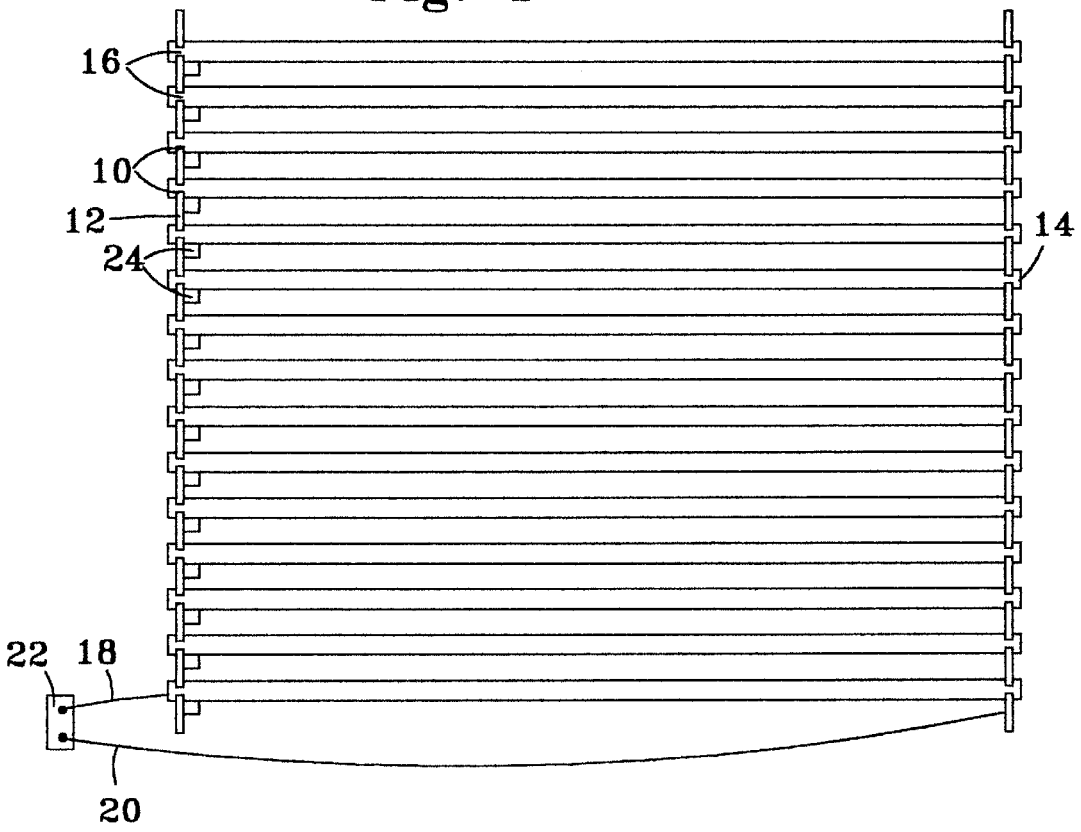
FIG. 1 illustrates a plan view of a plurality of tubes and capacitors engaged with printed circuit boards and two wire leads.
Figure 2:
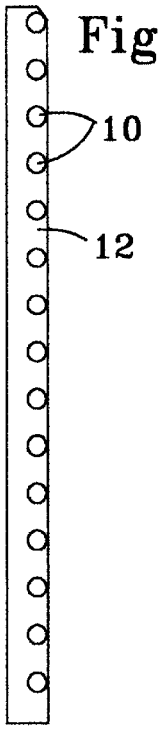
FIG. 2 illustrates an end view of the tubes and circuit boards.
Figure 3:
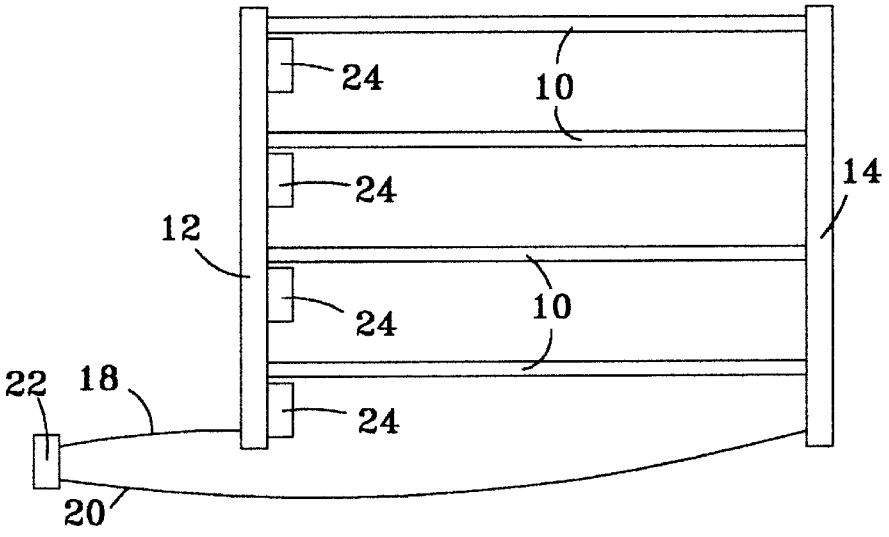
FIG. 3 illustrates a closed end configuration of tubes and circuit boards.

The invention provides an improved apparatus for illuminating electronic displays such as LCDs. FIG. 1 illustrates one embodiment of the invention wherein cold cathode fluorescent lamp tubes 10 are attached to board 12 and to board 14. In one embodiment of the invention board 12 and board 14 can comprise printed circuit boards ("PCB") formed with a substrate and electricity conducting paths. Each end of tubes 10 can extend through apertures 16 in boards 12 and 14 as illustrated in FIG. 2, can end boards 12 and 14 as shown in FIG. 3, or can be attached to boards 12 and 14 in other configurations. Electrical lead or hot wire 18 is connected to board 12 and electrical lead or common wire 20 is connected to board 14. The other ends of hot wire 18 and common wire 20 are connected to a power supply such as inverter 22. Although inverter 22 is illustrated as providing the required voltage, other power supplies could provide the requisite power. Preferably, inverter 22 is capable of generating high voltage AC for distribution to hot wire 18.

Figure 4:
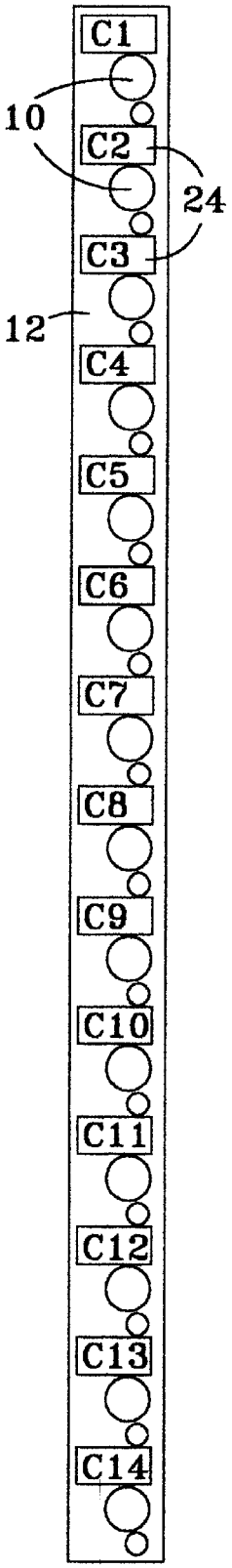
FIG. 4 illustrates an interior view of a plurality of capacitors position relative to the tubes.

Capacitors 24 are attached to board 12 as shown in FIGS. 1 and 4 so that each capacitor is associated with a corresponding tube 10. Each capacitor 24 is connected to the corresponding tube 10.

A novel feature of the invention is that inverter 22 can be remotely located from capacitors 24 and is not required to be located proximate to capacitors 24 or to tubes 10. Tests have demonstrated successful operation of inverter 22 at distances exceeding three feet from capacitors 24, and it is believed that greater separation distances can be successfully accomplished. This feature of the invention provides significant design flexibility, simplifies manufacture, and facilitates heat dissipation from inverter 22.

Figure 5:
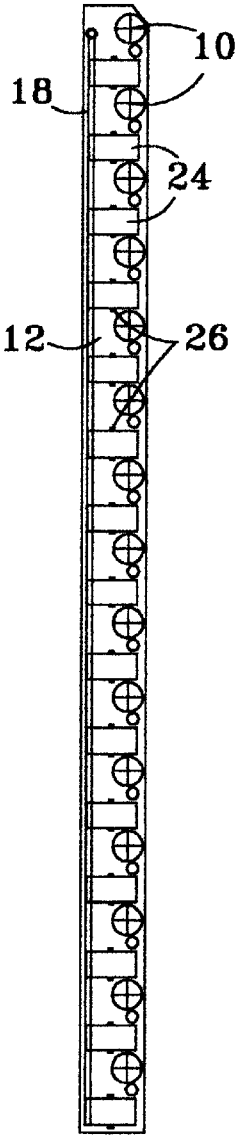
FIG. 5 illustrates the location of slots relative to the capacitors.

FIG. 5 illustrates a significant embodiment of the invention wherein grooves or slots 26 are formed in board 12 in a position underneath each capacitor 24. Preferably, each slot 26 is located between terminal ends of each capacitor 24 to provide electrical isolation between such terminal ends and to provide for thermal expansion. Conventional PCBs such as board 12 cannot accommodate the high voltages associated with capacitors 24, and failure of board 12 can occur because the dielectric strength of conventional epoxy-glass board material is inadequate to ensure reliable operation. Slots 26 isolate capacitors 24 from board 12 by providing physical separation. Additionally, the coefficients of expansion between board 12 and capacitor 24 differ significantly, thereby causing problems in connections therebetween. The coefficient of expansion for capacitors is approximately 5 ppm per degrees C., and the coefficient of expansion for board 12 is typically three times greater at approximately 14 ppm per degrees C. Strain on connections is reduced and the overall system reliability is increased.

Figure 6:
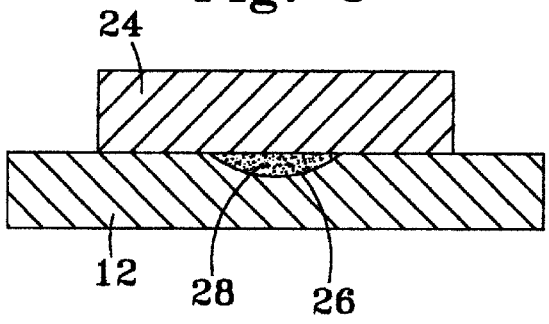
FIG. 6 illustrates an insulating material within the slots.

The extremely high operating voltages can cause failure across slots 26 in high humidity conditions because humid air can break down when exposed to high electrical voltage. To prevent failure across slots 26, an insulating material 28 such as special silicone adhesive is positioned by injection or other technique within slots 26 as described below and shown in FIG. 6. As used herein the term "insulating material" includes composite, silicone, varnish, and other types of materials capable of providing dielectric insulation. One suitable material is RTV3145 distributed by Dow Corning. To further prevent system breakdown due to high voltages, boards 12 and 14 and capacitors 24 can be coated with a protective moisture barrier 30 such as 1-2577 distributed by Dow Corning to reduce the possibility of inadvertent electrical leakage.

As previously described, slots 26 in board 12 under capacitors 24 are present because there is high AC voltage across capacitors when tube 10 is operating. The dielectric strength of the material conventionally used for board 12 is inadequate to ensure reliable operation, and insulating material 28 such as a silicone adhesive fills slot 26 to provide a moisture insulating barrier, to provide dielectric insulation, and to provide flexible connecting strength between each capacitor 24 and board 12. Insulating material can be clear or can be formed with other characteristics to accomplish additional functions.

The invention uniquely provides significant advantages over conventional systems by substantially reducing the number of wires necessary for activating multiple tubes illuminating an electronic display. Adaptation to different designs and systems is facilitated, and system reliability is significantly increased.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus connectable to a power supply for illuminating an electronic display, comprising:

a base;

at least two cold cathode fluorescent tubes attached to said base for illuminating the electronic display;

capacitors engaged with and dedicated to each of said tubes, wherein each capacitor has two ends;

a slot in said base proximate to each of said capacitors and between said capacitor ends for isolating at least part of said capacitor from said base;

a common wire engaged with each capacitor and with the power supply; and a hot wire engaged with the power supply and with each capacitor for completing an electrical circuit between the power supply and each tube.

2. An apparatus as recited in claim 1, further comprising an insulating material within said slot.

3. An apparatus as recited in claim 2, wherein said insulating material comprises a dielectric silicone material.

4. An apparatus as recited in claim 1, further comprising a protective material encapsulating said board and said common and hot wires.

5. An apparatus as recited in claim 1, wherein each of said capacitors is proximate to each of said corresponding tubes.

6. An apparatus as recited in claim 1, further comprising an inverter connected between the power supply and each of said capacitors for providing electrical power to said capacitors.

7. An apparatus as recited in claim 6, wherein said inverter is located at a position remote from capacitors.

8. An apparatus as recited in claim 1, further comprising a plurality of slots each associated with one of said capacitors.

9. An apparatus connectable to a power supply for illuminating an electronic display, comprising:

a first circuit board;

a second circuit board;

a plurality of cold cathode fluorescent tubes for illuminating the electronic display wherein each tube has one end attached to a hot electrical lead on said first circuit board and has another end attached to a common electrical lead on said second circuit board;

a plurality of capacitors engaged with said first circuit board, wherein each capacitor is dedicated to one of said tubes and each capacitor has two ends;

a slot in said first circuit board proximate to each of said capacitors between said capacitor ends for isolating at least part of said capacitors from said first circuit board;

the power supply connected to said hot electrical lead, and common electrical lead.

10. An apparatus as recited in claim 9, further comprising an inverter engaged with said hot electrical lead for supplying AC power to each capacitor.

11. An apparatus as recited in claim 10, wherein said inverter is located at a position remote from said capacitors.

12. An apparatus as recited in claim 9, further comprising an insulating material within said slot.

13. An apparatus as recited in claim 12, wherein said insulating material comprises a dielectric silicone material.

14. An apparatus as recited in claim 9, wherein said slot comprises a plurality of slots each associated with one of said capacitors.

* * * * *